US009226358B2

(12) United States Patent
Hsu et al.

(10) Patent No.: US 9,226,358 B2
(45) Date of Patent: Dec. 29, 2015

(54) METHOD FOR CONTROLLING LIGHT EMISSION OF A LIGHT EMITTING DEVICE, AND A DRIVING SYSTEM IMPLEMENTING THE METHOD

(71) Applicant: Macroblock, Inc., Hsinchu (TW)

(72) Inventors: Shun-Yuan Hsu, Hsinchu (TW); Shun-Ching Hsieh, Hsinchu (TW)

(73) Assignee: Macroblock, Inc., Hsinchu (TW)

( * ) Notice: Subject to any disclaimer, the term of this patent is extended or adjusted under 35 U.S.C. 154(b) by 0 days.

(21) Appl. No.: 14/486,586

(22) Filed: Sep. 15, 2014

(65) Prior Publication Data

US 2015/0077008 A1 Mar. 19, 2015

(30) Foreign Application Priority Data

Sep. 18, 2013 (TW) ..... 102133904 A

(51) Int. Cl.
*H05B 33/08* (2006.01)
*H05B 37/02* (2006.01)
*G09G 3/32* (2006.01)

(52) U.S. Cl.
CPC ..... *H05B 33/0845* (2013.01); *G09G 3/3233* (2013.01); *H05B 33/0842* (2013.01); *H05B 37/0281* (2013.01)

(58) Field of Classification Search
USPC ..... 345/690, 698, 211, 214, 204, 82, 76, 345/84, 98, 99, 100, 102
See application file for complete search history.

(56) References Cited

U.S. PATENT DOCUMENTS 5,812,534 A * 9/1998 Davis ..... H04L 12/6418 370/260
6,175,346 B1 * 1/2001 Chiu ..... G09G 3/32 345/100

FOREIGN PATENT DOCUMENTS

TW 201419937 A 5/2014

OTHER PUBLICATIONS

TW Search Report issued in related application TW 102133904, dated Oct. 23, 2014, pp. 1-2.

* cited by examiner

*Primary Examiner* — Tuyet Vo
(74) *Attorney, Agent, or Firm* — Brinks Gilson & Lione

(57) ABSTRACT

A driving system for a light emitting device includes a data latch unit to store first logic data, a shift register unit to store second logic data, a multiplexer unit to selectively output the first and second logic data, and a driving unit converting the logic data outputted by the multiplexer unit into a driving output that is provided to the light emitting device.

24 Claims, 12 Drawing Sheets

METHOD FOR CONTROLLING LIGHT EMISSION OF A LIGHT EMITTING DEVICE, AND A DRIVING SYSTEM IMPLEMENTING THE METHOD

CROSS-REFERENCE TO RELATED APPLICATION

This application claims priority to Taiwanese Application No. 102133904, filed on Sep. 18, 2013.

BACKGROUND OF THE INVENTION

1. Field of the Invention

The invention relates to a control method and a driving system, and more particularly to a control method and a driving system adapted for a light emitting device.

2. Description of the Related Art

Brightness of light emitted by an LED (light emitting diode) device is controlled by an LED driving system providing a constant current to the LED device for different periods of time, where the constant current refers to a constant current value within a unit time period.

Referring to FIGS. 1 and 3, a conventional LED driving system has 16 driving channels to drive the LED device (not shown), and receives 16 sets of source logic data respectively corresponding to the 16 driving channels. Each set of source logic data is composed of 6 brightness bits to indicate one of $2^6$ levels of brightness. The brightness bits have different bit orders defined to be 0 to 5, and are called $0^{th}$ to $5^{th}$ brightness bits herein. The LED driving system divides the source logic data into 6 sets of logic data, each of which has 16 logic values respectively for the 16 driving channels and corresponds to a respective one of the brightness bits. The LED driving system includes a control unit 10, a shift register unit 11, a data latch unit 12 and a driving unit 13.

The control unit 10 receives the source logic data, and is configured to generate the logic data after division, a clock signal, a latch signal and an output enable signal.

The shift register unit 11 includes 16 registers, receives the clock signal and the logic data, and sequentially and respectively stores the logic values in the registers in response to a positive edge of the clock signal.

Further referring to FIG. 2, the control unit 10 enables the shift register unit 11 to store the 6 sets of logic data corresponding to the brightness bits having the bit orders 0 to 5 (referring to numbers shown in the logic data in FIG. 2) in the given sequence. A length of time required by the shift register unit 11 to store each set of logic data is $T_1$.

The data latch unit 12 includes 16 latches, receives the latch signal, and respectively stores into the latches the logic values stored in the shift register unit 11 in response to a positive edge of the latch signal.

The driving unit 13 receives the output enable signal and the logic values stored in the data latch unit 12, and outputs, to each of the driving channels, a constant current signal for one of six predetermined time periods. Further referring to FIG. 2, each of the predetermined time periods has a length of $2^kT_2$ according to the output enable signal and the logic data, where k represents the bit order of the brightness bit corresponding to the logic data received thereby, and $T_2$ is a length of the predetermined time period corresponding to the brightness bit having the bit order of 0. In an example, when both of the output enable signal and the corresponding logic value has high logic levels, the corresponding channel outputs a first constant current to the corresponding LED, and when the output enable signal has the high logic level and the corresponding logic value has a low logic level, the corresponding channel outputs a second constant current (e.g., having a magnitude of 0A) to the corresponding LED.

In this configuration, when $2^kT_2<T_1$, there is a time period $t_{off}$ in which the LED device is in an idle state, thereby limiting a utilization rate and maximum brightness of the LED device. When $2^kT_2>T_1$, there is a time period $D_{off}$ in which control unit 10 is unable to output the next set of logic data that corresponds to the brightness bit having the bit order of (k+1), thereby limiting a refresh rate of the LED device.

SUMMARY OF THE INVENTION

Therefore, an object of the present invention is to provide a method of controlling light emission of a light emitting device. The method may cause the light emitting device to have relatively higher utilization rate and refresh rate.

According to one aspect of the present invention, a method is provided for controlling light emission of a light emitting device, and is to be implemented by a driving system that includes a register unit, a data latch unit coupled to the register unit, a multiplexer unit coupled to the register unit and the data latch unit, and a driving unit coupled to the multiplexer unit and the light emitting device. The method comprises:

(a) receiving and storing, by the register unit, first logic data therein;

(b) latching and storing, by the data latch unit, the first logic data stored in step (a) therein;

(c) after step (b), receiving and storing, by the register unit, second logic data therein;

(d) selectively outputting to the driving unit, by the multiplexer unit, one of the first logic data which is stored in the data latch unit, and the second logic data which is stored in the register unit; and (e) converting, by the driving unit, said one of the first logic data and the second logic data received thereby into a driving output that is provided to the light emitting device.

Another object of the present invention is to provide a driving system for a light emitting device. The driving system may cause the light emitting device to have relatively higher utilization rate and refresh rate.

According to another aspect of the present invention, a driving system is provided for a light emitting device, and comprises:

a register unit disposed to receive and store logic data therein;

a data latch unit coupled to the register unit for receiving the logic data stored in the register unit, and operable to selectively latch and store therein the logic data received from the register unit;

a multiplexer unit coupled to the data latch unit for receiving the logic data stored therein to serve as first logic data, coupled to the register unit for receiving the logic data stored therein to serve as second logic data, and operable to selectively output one of the first logic data and the second logic data; and a driving unit coupled to the multiplexer unit for receiving the one of the first logic data and the second logic data therefrom, configured to convert the one of the first logic data and the second logic data received thereby into a driving output, and operable to provide the driving output to the light emitting device.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
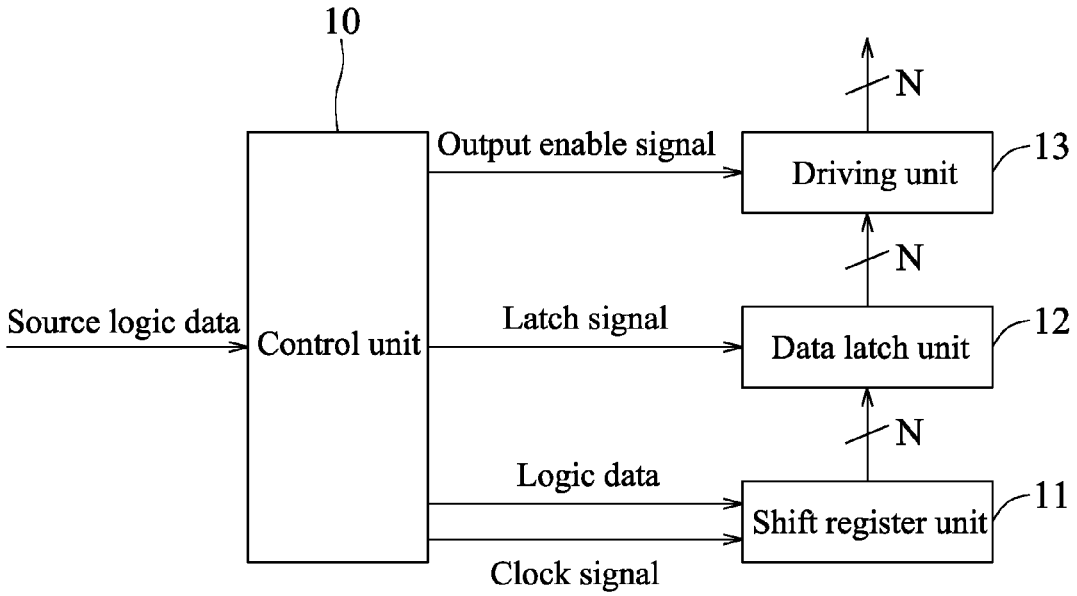
FIG.1 PRIOR ART
FIG. 1 is a block diagram that illustrates a conventional LED driving system.
Figure 2:
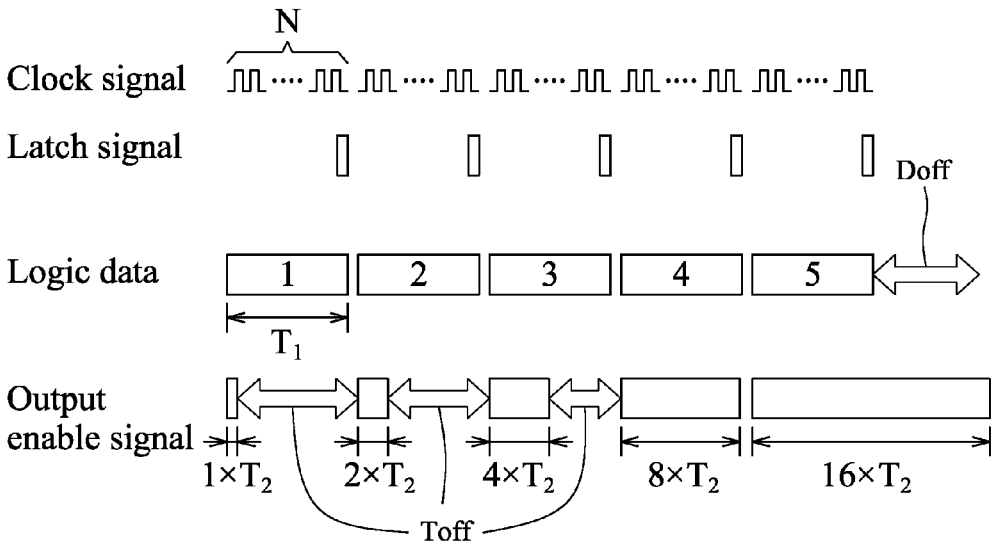
FIG.2 PRIOR ART
FIG. 2 is a timing diagram that illustrates the conventional LED driving system controlling light emission of a light emitting device.
Figure 3:
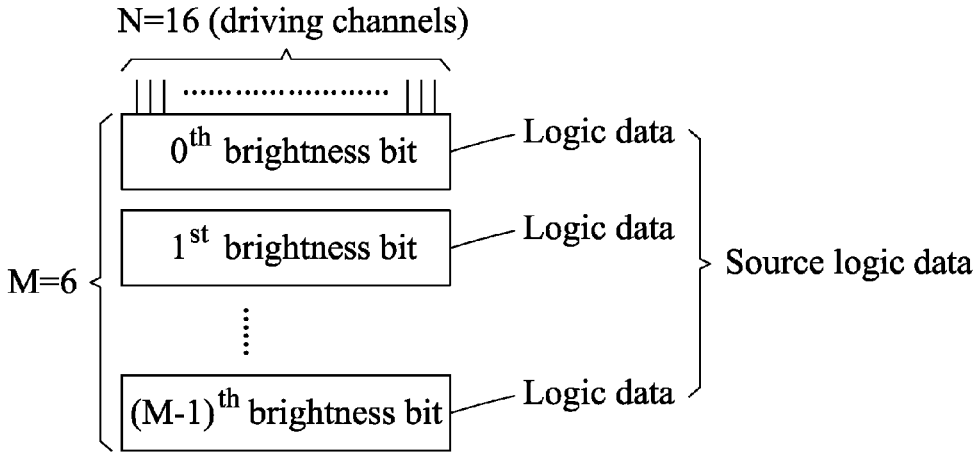
FIG.3 PRIOR ART
FIG. 3 is a schematic diagram that illustrates division of source logic data into multiple sets of logic data.
Figure 4:
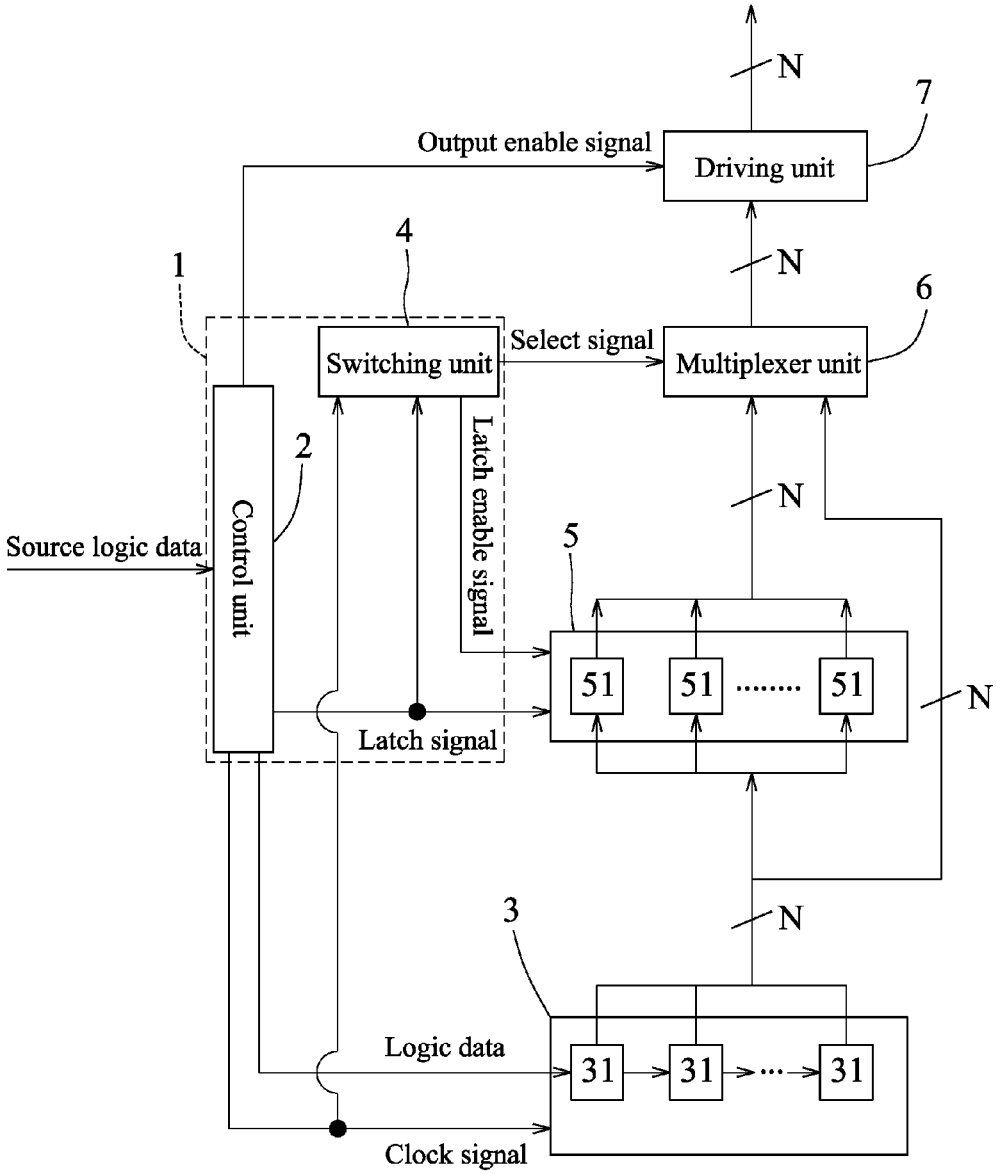
FIG. 4 is a block diagram that illustrates a first preferred embodiment of a driving system for a light emitting device according to the present invention.

Referring to FIGS. 3 and 4, a first preferred embodiment of a driving system for a light emitting device (e.g., a light emitting diode (LED) device, which is not shown) according to this invention has a number N of driving channels to drive, for example, LEDs of the light emitting device, where N is an integer and N≥1. The driving system includes a control block 1, a shift register unit 3, a data latch unit 5, a multiplexer unit 6 and a driving unit 7. The control block 1 includes a control unit 2 and a switching unit 4. In practice, the switching unit 4 may be integrated with the control unit 2, may be integrated with the data latch unit 5 and the multiplexer unit 6, or may be an independent module, and the present invention should not be limited in this respect. The control unit 2 receives N sets of source logic data, each of which is composed a number M of brightness bits to indicate one of $2^M$ levels of brightness, where M is an integer and M≥2. The brightness bits have different bit orders respectively defined to be 0 to M−1. Hereinafter, the brightness bit having the bit order of k is called the $K^{th}$ brightness bit. The control unit 2 divides the source logic data into M sets of the logic data, each of which corresponds to a respective one of the brightness bits and has N logic value (s) respectively corresponding to the driving channel (s). The control unit 2 then outputs to the shift register unit 3 the logic data after division. In this embodiment, N=16 and M=6, but the present invention is not limited thereto. In addition, the control unit 2 generates and outputs a clock signal, a latch signal and an output enable signal to control operations of the shift register unit 3, the switching unit 4, the data latch unit 5, the multiplexer unit 5, and the driving unit 7, directly or indirectly.

Figure 7:
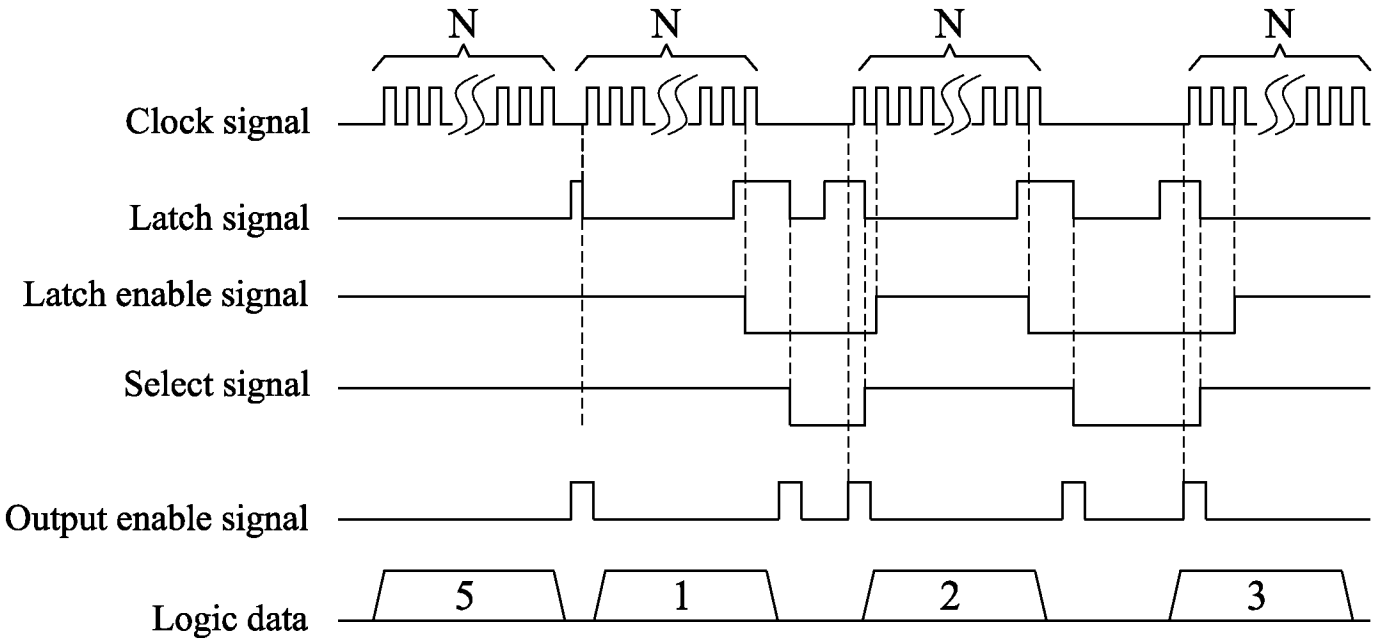
FIG. 7 is a timing diagram that illustrates detailed signal timing of the first preferred embodiment during a time period $t_{ex}$ in FIG. 6.

Referring to FIGS. 4 and 7, in this embodiment, the shift register unit 3 includes N registers 31, and receives and stores in the registers 31 the logic data outputted by the control unit 2 in response to a positive edge of the clock signal. During the storing operation of the shift register unit 3 (i.e., during output of the logic data by the control unit 2), the clock signal outputted by the control unit 2 has a number of clock cycles associated with N.

In this embodiment, the switching unit 4 receives the clock signal and the latch signal, and outputs a latch enable signal that has a logic level adjusted to be opposite to that of the latch signal in response to a positive edge of the clock signal. The switching unit 4 is further responsive to a negative edge of the latch signal to: output the select signal having a high logic level when the latch enable signal has the high logic level, and invert the logic level of the select signal when the latch enable signal has the low logic level.

In this embodiment, the data latch unit 5 includes N latches 51, is coupled to the shift register unit 3 for receiving the logic data stored in the register unit 3, and is responsive to a negative edge of the latch signal to latch and store the logic data received from the shift register unit 3 in the latches 51 when the latch enable signal has the high logic level.

In this embodiment, the multiplexer unit 6 is coupled to the data latch unit 5 for receiving the logic data stored therein, is coupled to the shift register unit 3 for receiving the logic data stored therein, and is configured to output the logic data stored in the data latch unit 5 when the select signal has the high logic level, and to output the logic data stored in the shift register unit 3 when the select signal has the low logic level.

In this embodiment, the driving unit 7 is coupled to the multiplexer unit 6 for receiving the logic data outputted by the multiplexer unit 6, converts the logic data received thereby into a driving output, and provides a constant driving output to the light emitting device when the output enable signal has the low logic level. Herein, the constant driving output refers to a constant current within a unit time period.

The brightness bits are classified into a first bit group and a second bit group. The bit order of each of the brightness bits classified into the first bit group is higher than that of each of the brightness bits classified into the second bit group. In one embodiment, the classification is achieved by defining the lowest bit order j among the bit orders of the brightness bits that are classified into the first bit group to be the highest bit order among the bit orders 0 to M−1 that satisfies:

$$(j-1) \le \sum_{n=0}^{M-j} (2^n - 1)$$

That is, each of the brightness bits having the bit order equal to or greater than j is classified into the first bit group, and each of the brightness bits having the bit order smaller than j is classified into the second bit group. In this embodiment, since M=6, the bit order 4 is the highest bit order that satisfies the above relationship $((4-1)=3 \ge \Sigma_{N=}0^{6-4}(2^n-1)=0+1+3=4)$, i.e., j=4. Therefore, the $4^{th}$ and $5^{th}$ brightness bits are classified into the first bit group, and the $0^{th}$ to $3^{rd}$ brightness bits are classified into the second bit group.

Figure 6:
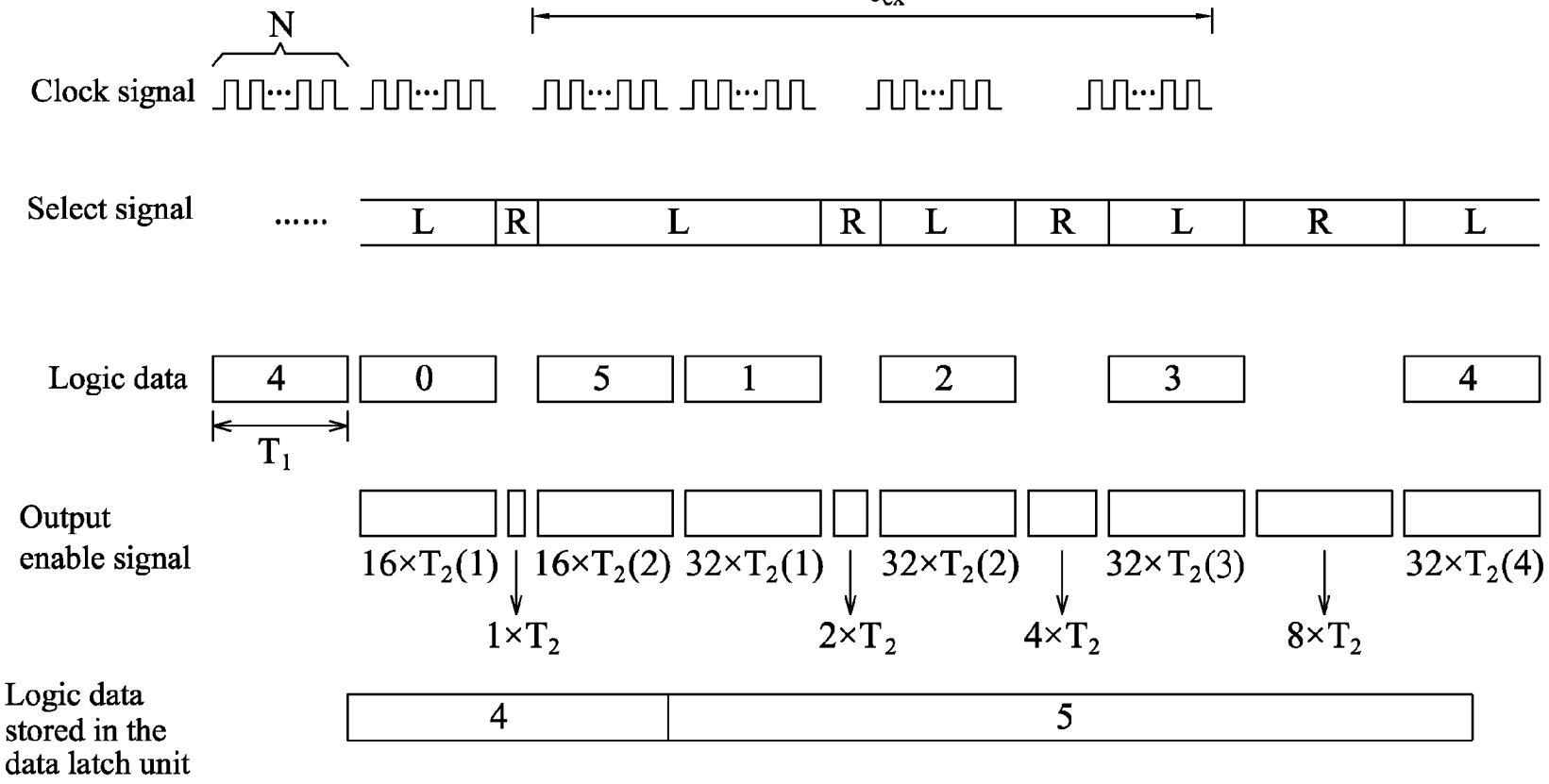
FIG. 6 is a timing diagram that illustrates the driving system of this invention controlling light emission of the light emitting device.

Further referring to FIG. 6, the embodiment satisfies:

$$2^{k1}T_2 \ge 2T_1 \text{ and } 2^{k2}T_2 < 2T_1$$

wherein $T_1$ represents a length of time (e.g., N clock cycles of the clock signal) required by the shift register unit 3 to receive and store the logic data outputted by the control unit 2, $T_2$ represents a length of time the driving output is provided to the light emitting device when the driving output is converted from the set of logic data whose corresponding brightness bit has the bit order of 0, $k_1$ represents the bit order of an arbitrary one of the brightness bits classified into the first bit group, and $k_2$ represents the bit order of an arbitrary one of the brightness bits classified into the second bit group. In this embodiment, $2^3T_2=8\times T_2=T_1$, where $2^3T_2$ is a length of time the driving output is provided to the light emitting device when the driving output is converted from the set of logic data corresponding to the $3^{rd}$ brightness bit, which the highest bit order among the bit orders of the brightness bits classified into the second bit group.

Figure 5:
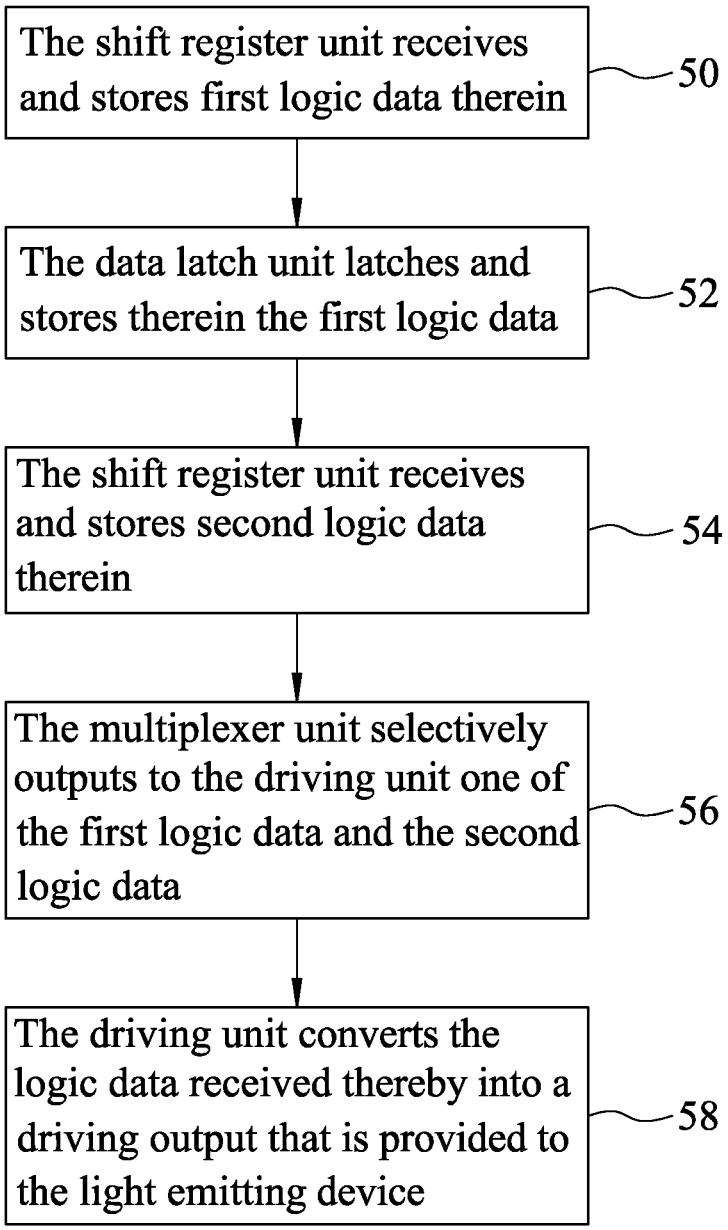
FIG. 5 is a flow chart of a preferred embodiment of a control method for controlling light emission of the light emitting device according to the present invention.

Referring to FIGS. 5 and 6, in order to promote the utilization rate and the refresh rate of the light emitting device, the control block 1 controls the shift register unit 3, the data latch unit 5, the multiplexer unit 6, and the driving unit 7 to operate according to the following steps:

Step 50: The control unit 2 outputs first logic data to the shift register unit 3, and the shift register unit 3 receives and stores the first logic data therein. The first logic data is one of the M sets of logic data whose corresponding brightness bit is classified into the first bit group (e.g., the logic data with a number 4 or 5 in FIG. 6). It should be noted that, in FIGS. 6, 7, 9, 11 and 13, a number shown in each set of logic data represents the bit order of the brightness bit corresponding to that set of logic data.

Step 52: The data latch unit 5 latches and stores therein the first logic data stored in the shift register unit 3.

Step 54: After step 52, the control unit 2 outputs second logic data to the shift register unit 3, and the shift register unit 3 receives and stores second logic data therein. The second logic data is one of the M sets of logic data whose corresponding brightness bit is classified into the second bit group (e.g., the logic data with a number 0, 1, 2 or 3 in FIG. 6).

Step 56: The multiplexer unit 6 selectively outputs to the driving unit 7 one of the first logic data which is stored in the data latch unit 5 (referring to the select signal marked with "L" in FIG. 6), and the second logic data which is stored in the shift register unit 3 (referring to the select signal marked with "R" in FIG. 6).

Step 58: The driving unit 7 converts said one of the first logic data and the second logic data received thereby into a driving output that is provided to the light emitting device (referring to the output enable signal in FIG. 6). In detail, an overall time period in which the control unit 2 outputs the output enable signal to enable step 58 for the set of logic data corresponding to the $k^{th}$ brightness bit is $2^kT_2$.

In order to minimize $T_{off}$ in which the light emitting device is in an idle state and $D_{off}$ in which the control unit 2 is unable to output the next set of logic data, an output sequence of the M sets of logic data, the latch signal and the output enable signal are well-arranged by the control unit 2 to achieve the following features:

(1) The multiplexer unit 6 outputs the first logic data, the second logic data and the first logic data respectively at first, second and third time periods in the given sequence. Note that the first logic data outputted at the first and third time periods are the same first logic data (referring to the select signal and the logic data stored in the data latch unit 5 that correspond to $32\times T_2$ (1), $2\times T_2$ and $32\times T_2$ (2) in FIG. 6).

(2) During the first time period, the driving unit 7 converts the first logic data into a constant first driving output that is provided to the light emitting device for a first predetermined time period (e.g., $32\times T_2$ (1) in FIG. 6); during the second time period, the driving unit 7 converts the second logic data into a constant second driving output that is provided to the light emitting device for a second predetermined time period (e.g., $2\times T_2$ in FIG. 6); and during the third time period, the driving unit 7 converts the first logic data into the constant first driving output that is provided to the light emitting device for a third predetermined time period (e.g., $32\times T_2$(2) in FIG. 6). In other words, a long time period of providing the constant first driving output to the light emitting device is divided into several separate shorter time periods. For example, in this embodiment, a period of $32\times T_2$ for the set of logic data corresponding to the $5^{th}$ brightness bit is divided into four shorter periods: $32\times T_2$ (1), $32\times T_2$ (2), $32\times T_2$ (3) and $32\times T_2$ (4), each of which has a length of time equal to $8\times T_2$. Similarly, a period of $16\times T_2$ for the set of logic data corresponding to $4^{th}$ brightness bit is divided into two shorter periods: $16\times T_2$ (1) and $16\times T_2$(2), each of which has a length of time equal to $8\times T_2$.

(3) At least one set of logic data whose corresponding brightness bit is classified into the second bit group is arranged between two sets of logic data whose corresponding brightness bits are both classified into the first bit group. For example, in FIG. 6, output of the set of logic data corresponding to the $0^{th}$ brightness bit is arranged between outputs of the sets of logic data corresponding to the $4^{th}$ and $5^{th}$ brightness bits. In this embodiment, a number R of said at least one set of logic data satisfies $R=2^{k_{1f}-j+1}-1$, where $k_{1f}$ represents the bit order corresponding to a leading one of said two sets of logic data. For example, when the leading one of said two sets of logic data corresponds to the $4^{th}$ brightness bit, $R=2^{4-4+1}-1=1$. Referring to FIG. 6, only the set of logic data corresponding to the $0^{th}$ brightness bit is arranged to follow the set of logic data corresponding to the 4th brightness bit. When the leading one of said two sets of logic data corresponds to the $5^{th}$ brightness bit, $R=2^{5-4+1}-1=3$. Referring to FIG. 6, the three sets of logic data corresponding to the $1^{st}$ to $3^{rd}$ brightness bits are arranged to follow the set of logic data corresponding to the $5^{th}$ brightness bit. In other embodiments, the leading one of said two sets of logic data may be arranged before the R set(s) of logic data and after another one set of logic data whose corresponding brightness bit is classified into the second bit group and has the bit order of t, where $2^tT_2=T_1$.

By virtue of such arrangement, output of the second logic data by the control unit 2 and provision of the driving output which is converted from the first logic data may proceed at the same time, so as to reduce both of $T_{off}$ and $D_{off}$, thereby promoting utilization rate, maximum brightness, and refresh rate of the light emitting device.

Referring to FIG. 6, in this embodiment, the control unit 2 first outputs to the shift register unit 3 the set of logic data corresponding to the $4^{th}$ brightness bit. The data latch unit 5 then latches and stores therein the set of logic data corresponding to the $4^{th}$ brightness bit that is stored in the shift register unit 3.

Then, the control unit 2 outputs to the shift register unit 3 the set of logic data corresponding to the $0^{th}$ brightness bit. At the same time, the control unit 2 enables the driving unit 7 to convert the set of logic data corresponding to the $4^{th}$ brightness bit (which is stored in the data latch unit 5) into a constant driving output that is provided to the light emitting device for a length (i.e., $8\times T_2$) of the time period $16\times T_2$(1).

Then, the control unit 2 enables the driving unit 7 to convert the set of logic data corresponding to the $0^{th}$ brightness bit (which is stored in the shift register unit 3) into a constant driving output that is provided to the light emitting device for a time period of $1\times T_2$.

Then, the control unit 2 outputs to the shift register unit 3 the set of logic data corresponding to the $5^{th}$ brightness bit. At the same time, the control unit 2 enables the driving unit 7 to convert the set of logic data corresponding to the $4^{th}$ brightness bit (which is stored in the data latch unit 5) into a constant driving output that is provided to the light emitting device for a length (i.e., $8\times T_2$) of the time period $16\times T_2$(2). The data latch unit 5 then latches and stores therein the set of logic data corresponding to the $5^{th}$ brightness bit that is stored in the shift register unit 3.

Then, the control unit 2 outputs to the shift register unit 3 the set of logic data corresponding to the $1^{st}$ brightness bit. At the same time, the control unit 2 enables the driving unit 7 to convert the set of logic data corresponding to the $5^{th}$ brightness bit (which is stored in the data latch unit 5) into a constant driving output that is provided to the light emitting device for a length (i.e., $8\times T_2$) of the time period $32\times T_2$(1).

Then, the control unit 2 enables the driving unit 7 to convert the set of logic data corresponding to the $1^{st}$ brightness bit (which is stored in the shift register unit 3) into a constant driving output that is provided to the light emitting device for a time period of $2\times T_2$.

Then, the control unit 2 outputs to the shift register unit 3 the set of logic data corresponding to the $2^{nd}$ brightness bit. At the same time, the control unit 2 enables the driving unit 7 to convert the set of logic data corresponding to the $5^{th}$ brightness bit (which is stored in the data latch unit 5) into a constant driving output that is provided to the light emitting device for a length (i.e., $8\times T_2$) of the time period $32\times T_2$(2).

Then, the control unit 2 enables the driving unit 7 to convert the set of logic data corresponding to the $2^{nd}$ brightness bit (which is stored in the shift register unit 3) into a constant driving output that is provided to the light emitting device for a time period of $4\times T_2$.

Then, the control unit 2 outputs to the shift register unit 3 the set of logic data corresponding to the $3^{rd}$ brightness bit. At the same time, the control unit 2 enables the driving unit 7 to convert the set of logic data corresponding to the $5^{th}$ brightness bit (which is stored in the data latch unit 5) into a constant driving output that is provided to the light emitting device for a length (i.e., $8\times T_2$) of the time period $32\times T_2$(3).

Then, the control unit 2 enables the driving unit 7 to convert the set of logic data corresponding to the $3^{rd}$ brightness bit (which is stored in the shift register unit 3) into a constant driving output that is provided to the light emitting device for a time period of $8\times T_2$.

Then, the control unit 2 outputs to the shift register unit 3 the set of logic data corresponding to the $4^{th}$ brightness bit and associated with the following source logic data. At the same time, the control unit 2 enables the driving unit 7 to convert the set of logic data corresponding to the $5^{th}$ brightness bit (which is stored in the data latch unit 5) into a constant driving output that is provided to the light emitting device for a length (i.e., $8\times T_2$) of the time period $32\times T_2$(4).

In the first preferred embodiment, the shift register unit 3 is a shift register including N registers. However, in a variation of the first preferred embodiment, the shifter register unit 3 may include a plurality of shift registers coupled in series, such that a sum of numbers of registers of the shift registers is equal to N, and the data latch unit includes a plurality of data latch sub-units respectively corresponding to the shift registers. In a specific variation, the shift register unit 3 includes a number X of shift registers, each of which includes a number n of registers, and X×n=N.

Figure 8:
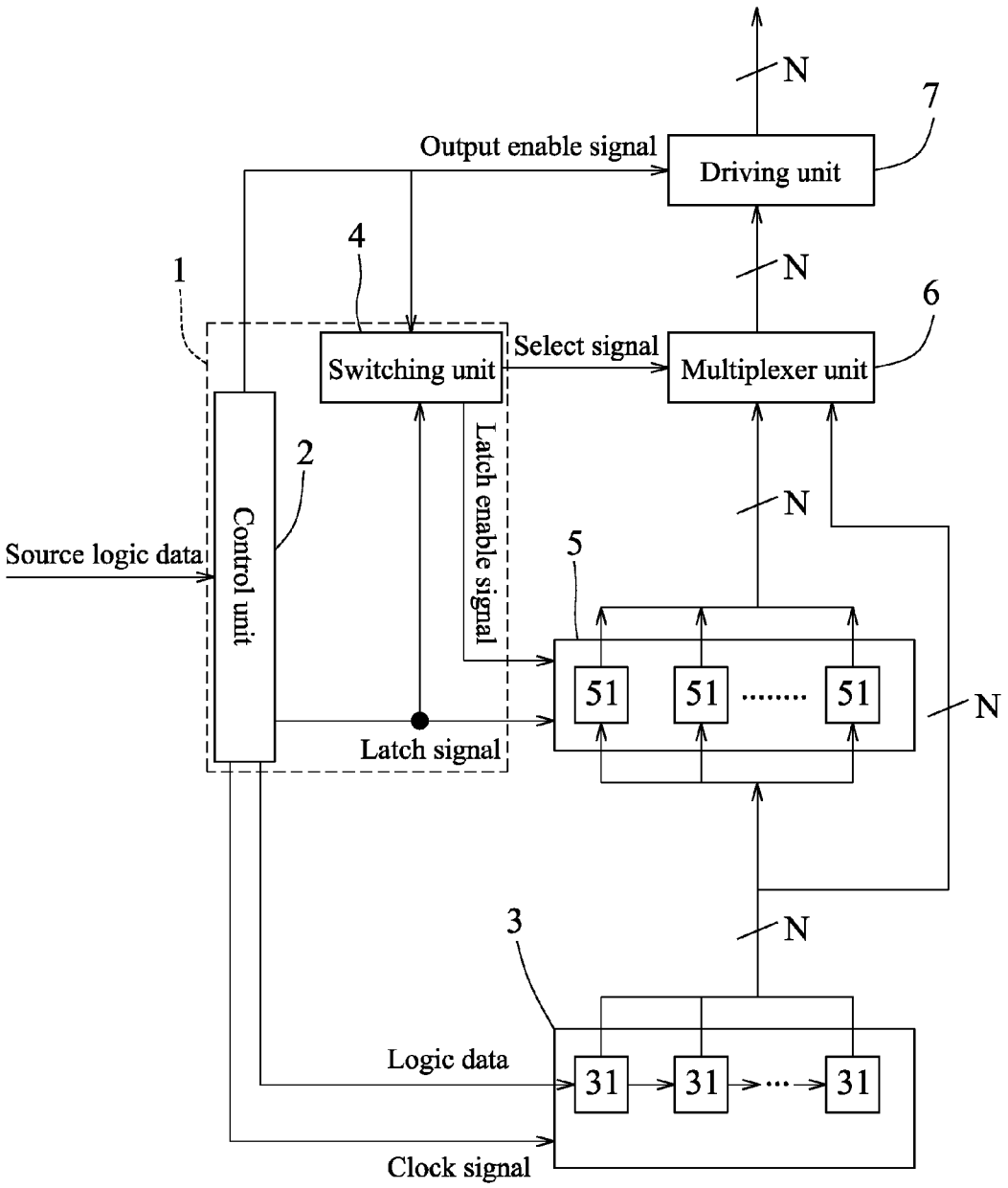
FIG. 8 is a block diagram that illustrates a second preferred embodiment of a driving system for a light emitting device according to the present invention.
Figure 9:
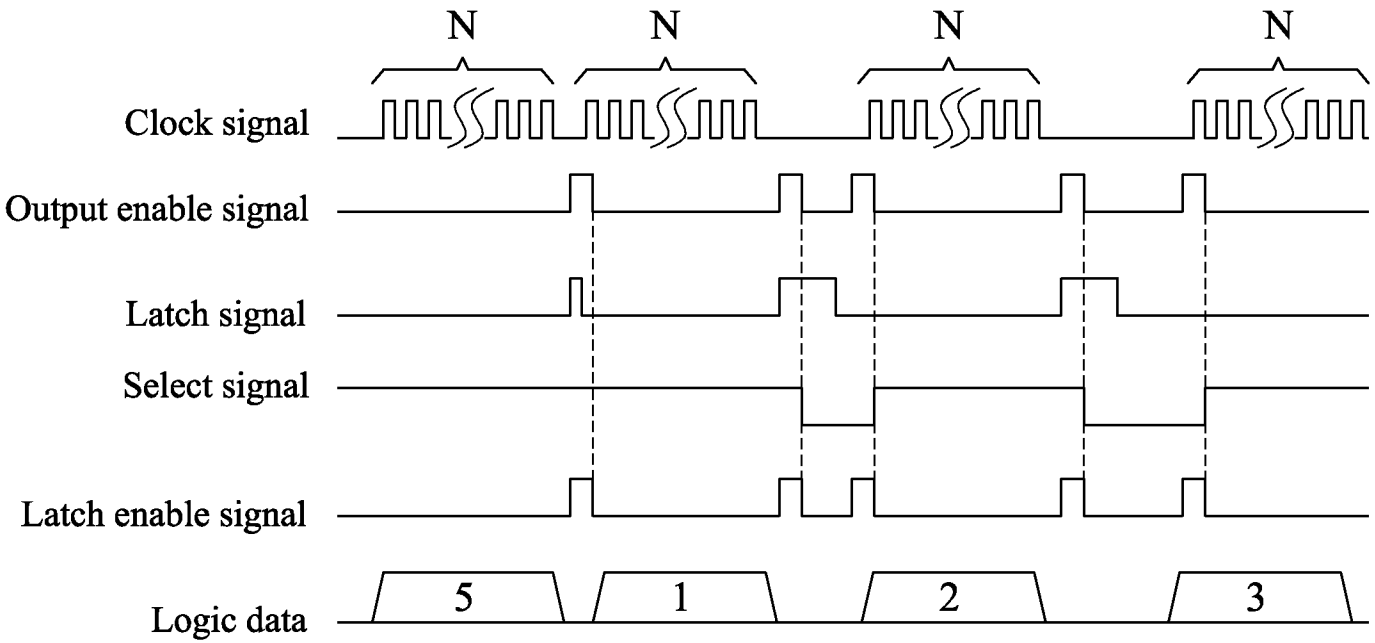
FIG. 9 is a timing diagram that illustrates detailed signal timing of the second preferred embodiment during the time period $t_{ex}$ in FIG. 6.

Referring to FIGS. 8 and 9, a second preferred embodiment of a driving system according to this invention is similar to the first preferred embodiment, and differs in that: the switching unit 4 receives the latch signal and the output enable signal, outputs the latch enable signal that is the same as the output enable signal, and is responsive to a negative edge of the output enable signal to output the select signal having the high logic level when the latch signal has the low logic level, and to output the select signal having the low logic level when the latch signal has the high logic level.

Figure 10:
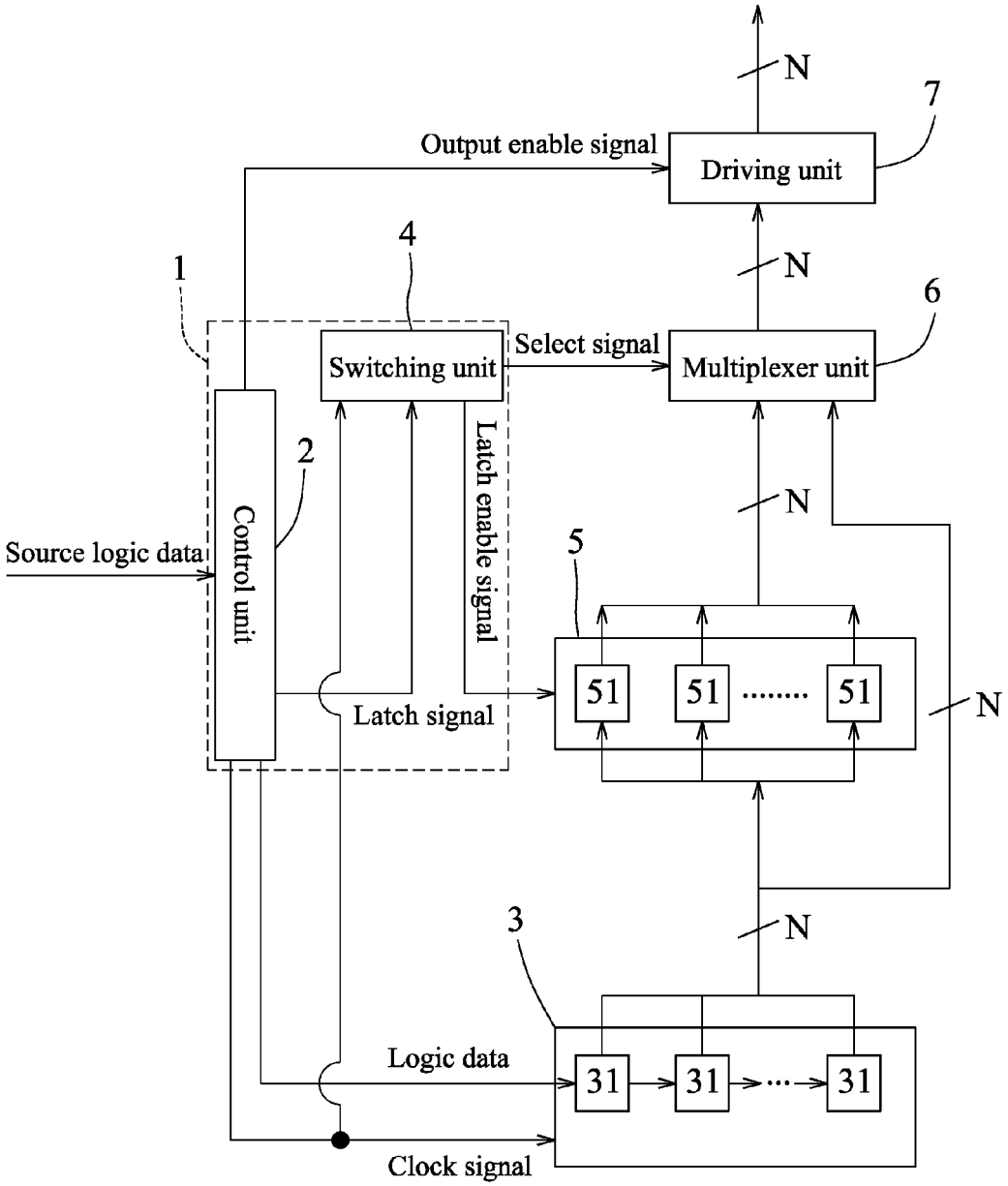
FIG. 10 is a block diagram that illustrates a third preferred embodiment of a driving system for a light emitting device according to the present invention.
Figure 11:
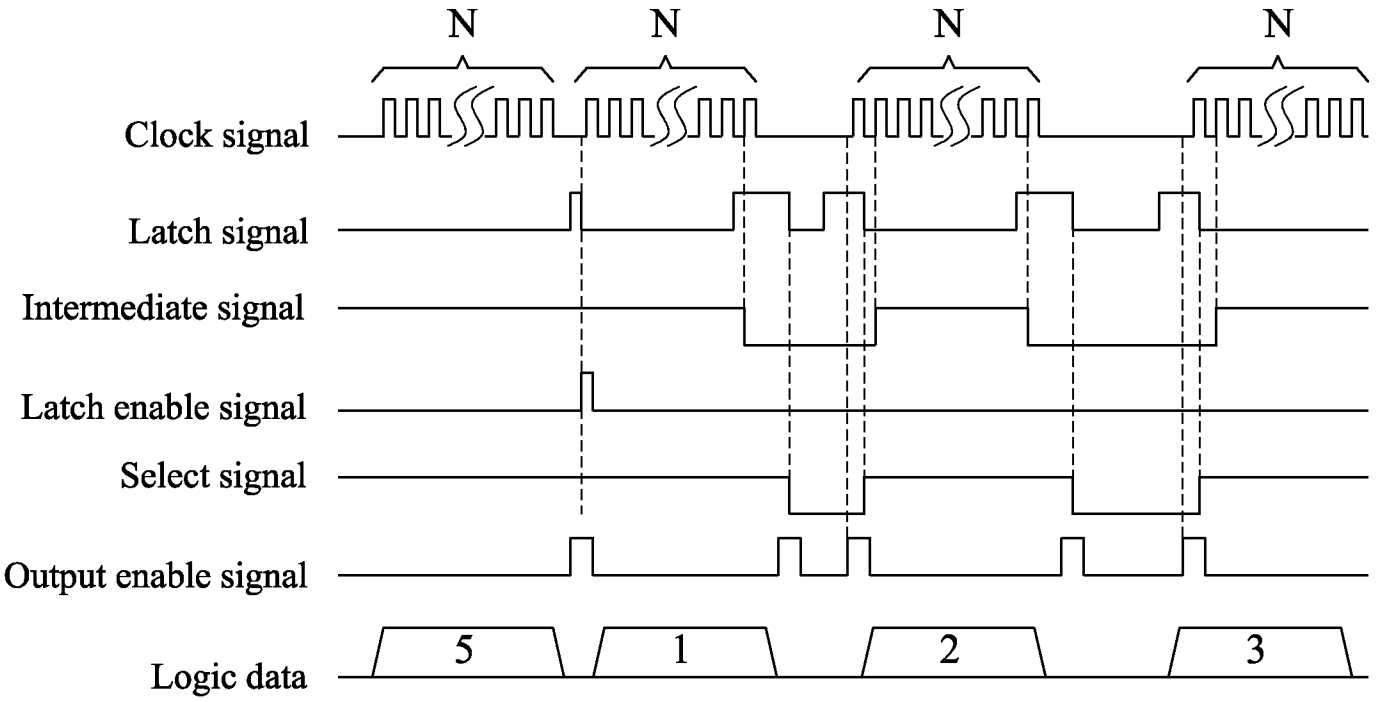
FIG. 11 is a timing diagram that illustrates detailed signal timing of the third preferred embodiment during the time period $t_{ex}$ in FIG. 6.

Referring to FIGS. 10 and 11, a third preferred embodiment of a driving system according to this invention is similar to the first preferred embodiment, and differs in that: the switching unit 4 generates an intermediate signal that has a logic level adjusted to be opposite to that of the latch signal in response to a positive edge of the clock signal, and outputs, in response to a negative edge of the latch signal, a pulse to serve as the latch enable signal when the intermediate signal has the high logic level. Moreover, the switching unit 4 is responsive to a negative edge of the latch signal to output the select signal having the high logic level when the intermediate signal has the high logic level, and to invert the logic level of the select signal when the intermediate signal has the low logic level. The data latch unit 5 latches and stores the logic data stored in the shift register unit 3 according to the latch enable signal (e.g., when the latch enable signal has the high logic level).

Figure 12:
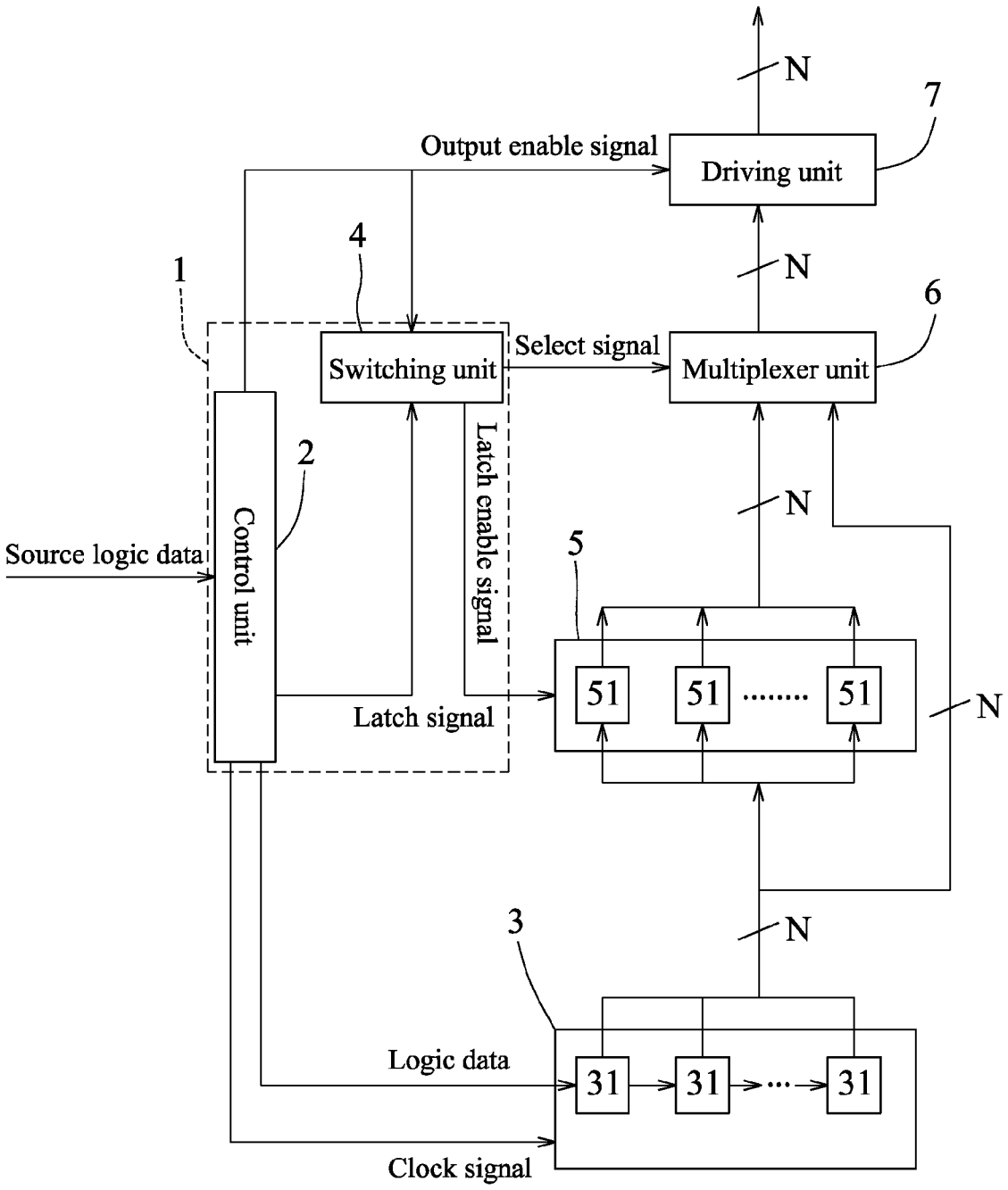
FIG. 12 is a block diagram that illustrates a fourth preferred embodiment of a driving system for a light emitting device according to the present invention.
Figure 13:
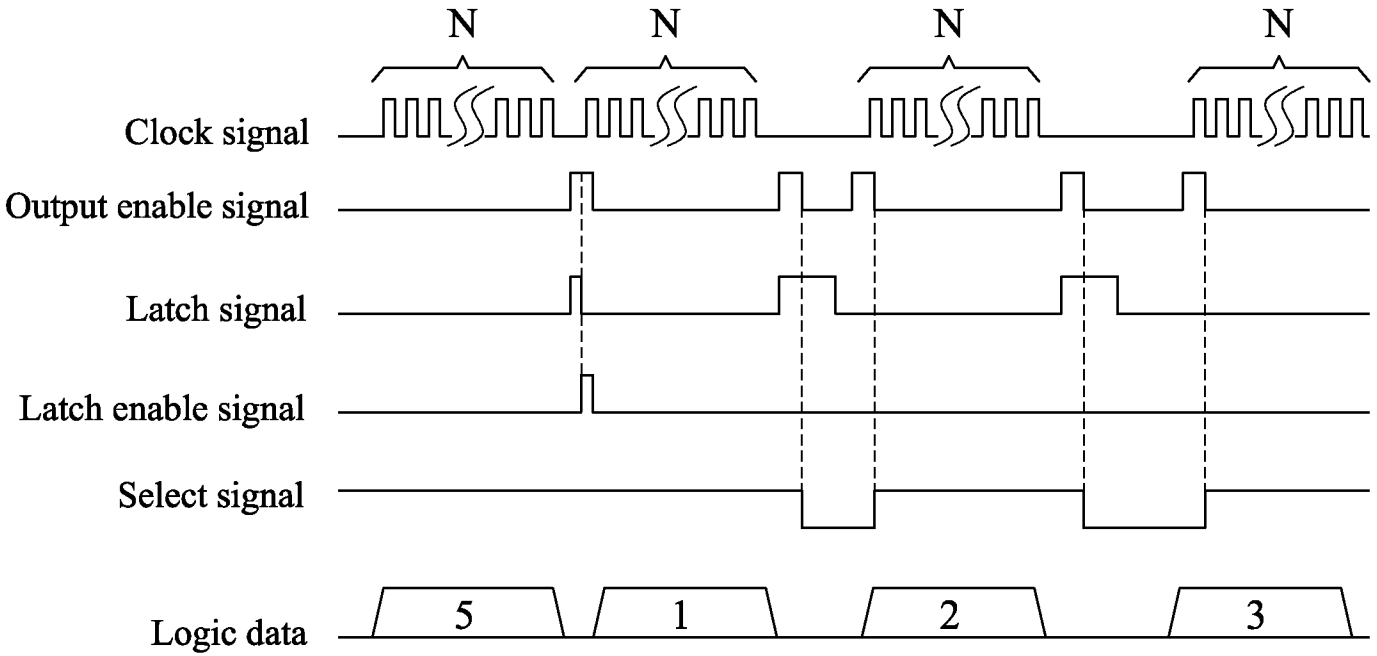
FIG. 13 is a timing diagram that illustrates detailed signal timing of the fourth preferred embodiment during the time period $t_{ex}$ in FIG. 6.

Referring to FIGS. 12 and 13, a fourth preferred embodiment of a driving system according to this invention is similar to the second preferred embodiment, and differs in that: the switching unit 4 outputs, in response to a negative edge of the latch signal, a pulse to serve as the latch enable signal when the output enable signal has the high logic level. The data latch unit 5 latches and stores the logic data stored in the shift register unit 3 according to the latch enable signal (e.g., when the latch enable signal has the high logic level).

To sum up, according to the present invention, the operations of the shift register unit 3, the data latch unit 4 and the driving unit 5 are well-controlled using the control block 1 to promote the utilization rate and the refresh rate of the light emitting device.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A method for controlling light emission of a light emitting device, said method to be implemented by a driving system that includes a shift register unit receiving a clock signal, a data latch unit coupled to the shift register unit, a multiplexer unit coupled to the shift register unit and the data latch unit, and a driving unit coupled to the multiplexer unit and the light emitting device, said method comprising:

(a) receiving and storing, by the shift register unit, first logic data therein according to the clock signal;

(b) latching and storing, by the data latch unit, the first logic data stored in step (a) therein;

(c) after step (b), receiving and storing, by the shift register unit, second logic data therein;

(d) selectively outputting to the driving unit, by the multiplexer unit, one of the first logic data which is stored in the data latch unit, and the second logic data which is stored in the shift register unit; and (e) converting, by the driving unit, said one of the first logic data and the second logic data received thereby into a driving output that is provided to the light emitting device.

2. The method as claimed in claim 1, wherein step (d) includes:

(d1) outputting to the driving unit, by the multiplexer unit, the first logic data stored in the data latch unit;

(d2) after sub-step (d1), outputting to the driving unit, by the multiplexer unit, the second logic data stored in the shift register unit; and (d3) after sub-step (d2), outputting to the driving unit, by the multiplexer unit, the first logic data stored in the data latch unit; and wherein the first logic data outputted in sub-step (d3) and sub-step (d1) are the same first logic data, which is stored in the data latch unit in the same step (b).

3. The method as claimed in claim 2, wherein:

step (e) includes:

(e1) during sub-step (d1), converting, by the driving unit, the first logic data into a constant first driving output that is provided to the light emitting device for a first predetermined time period;

(e2) during sub-step (d2), converting, by the driving unit, the second logic data into a constant second driving output that is provided to the light emitting device for a second predetermined time period; and (e3) during sub-step (d3), converting, by the driving unit, the first logic data into the constant first driving output that is provided to the light emitting device for a third predetermined time period; and wherein the second predetermined time period is shorter than a sum of the first predetermined time period and the third predetermined time period.

4. The method as claimed in claim 1, the driving system further including a control block that controls operations of the shift register unit, the data latch unit, the multiplexer unit and the driving unit, said method further comprising:

receiving, by the control block, source logic data composed of a number M of brightness bits, the source logic data to indicate one of $2^M$ levels of brightness, where M is an integer and M≥2, the brightness bits having different bit orders and being classified into a first bit group and a second bit group, the bit order of each of the brightness bit (s) of the first bit group being higher than that of each of the brightness bit (s) of the second bit group;

dividing, by the control block, the source logic data into M sets of logic data each corresponding to a respective one of the brightness bits; and outputting, by the control block, the M sets of logic data after division in an output sequence such that each set of logic data whose corresponding brightness bit is classified into the first bit group serves as the first logic data, and each set of logic data whose corresponding brightness bit is classified into the second bit group serves as the second logic data.

5. The method as claimed in claim 4, wherein M≥3, and in the output sequence, at least one set of logic data whose corresponding brightness bit is classified into the second bit group is arranged between two sets of logic data whose corresponding brightness bits are both classified into the first bit group.

6. The method as claimed in claim 5, wherein the bit orders of the brightness bits are defined to be integers ranging from 0 to M−1, said method satisfying:

$$2^{k_1}T_2 \geq 2T_1 \text{ and } 2^{k_2}T_2 < 2T_1$$

wherein $T_1$ represents a length of time required to receive and store either one of the first logic data in step (a) and the second logic data in step (c), $T_2$ represents a length of time the driving output is provided to the light emitting device when the driving output is converted from the second logic data that corresponds to the set of logic data whose corresponding brightness bit has the bit order of 0, $k_1$ represents the bit order of an arbitrary one of the brightness bits classified into the first bit group, and $k_2$ represents the bit order of an arbitrary one of the brightness bit(s) classified into the second bit group; and wherein an overall length of time the driving output is provided to the light emitting device is $2^kT_2$ when the driving output is converted from the set of logic data whose corresponding brightness bit has the bit order of k.

7. The method as claimed in claim 6, further satisfying $R=2^{k_{1f}-j+1}-1$, where R represents a number of said at least one set of logic data whose corresponding brightness bit is classified into the second bit group, $k_{1f}$ represents the bit order corresponding to a leading one of said two sets of logic data whose corresponding brightness bits are both classified into the first bit group, and j represents the lowest bit order among the bit orders of the brightness bits classified into the first bit group.

8. The method as claimed in claim 7, wherein M≥4, and in the output sequence, said leading one of said two sets of logic data is arranged before said at least one set of logic data whose corresponding brightness bit is classified into the second bit group and after another one set of logic data whose corresponding brightness bit is classified into the second bit group and has the bit order of t, said method further satisfying: $2^tT_2=T_1$.

9. A driving system for a light emitting device, comprising:

a shift register unit disposed to receive a clock signal and logic data, and configured to store the logic data therein according to the clock signal;

a data latch unit coupled to said shift register unit for receiving the logic data stored in said shift register unit, and operable to selectively latch and store therein the logic data received from said shift register unit;

a multiplexer unit coupled to said data latch unit for receiving the logic data stored therein, coupled to said shift register unit for receiving the logic data stored therein, and operable to selectively output one of the logic data stored in said data latch unit and the logic data stored in said shift register unit; and a driving unit coupled to said multiplexer unit for receiving the logic data outputted by said multiplexer unit, configured to convert the logic data received thereby into a driving output, and operable to provide the driving output to the light emitting device.

10. The driving system as claimed in claim 9, further comprising:

a control block coupled to said shift register unit, said data latch unit, said multiplexer unit and said driving unit, and configured to:

output first logic data and second logic data to said shift register unit sequentially;

enable said shift register unit to store therein the first logic data;

control said data latch unit to latch and store therein the first logic data received from said shift register unit;

enable said shift register unit to store the second logic data after said data latch unit stores the first logic data;

control said multiplexer unit to output to said driving unit one of the first logic data which is stored in said data latch unit, and the second logic data which is stored in said shift register unit; and control said driving unit to convert said one of the first logic data and the second logic data received thereby into the driving output that is provided to the light emitting device.

11. The driving system as claimed in claim 10, wherein said control block controls said multiplexer unit to:

output to said driving unit the first logic data stored in said data latch unit at a first time period;

output to said driving unit the second logic data stored in said shift register unit at a second time period following the first time period; and output to said driving unit the first logic data stored in said data latch unit at a third time period following the second time period; and wherein the first logic data outputted at the first time period and the third time period are the same first logic data, which is stored in said data latch unit.

12. The driving system as claimed in claim 11, wherein:

said driving unit converts the first logic data into a constant first driving output, and converts the second logic data into a constant second driving output;

said control block controls said driving unit to:

provide the constant first driving output to the light emitting device for a first predetermined time period during the first time period;

provide the constant second driving output to the light emitting device for a second predetermined time period during the second time period; and provide the constant first driving output to the light emitting device for a third predetermined time period during the third time period; and the second predetermined time period is shorter than a sum of the first predetermined time period and the third predetermined time period.

13. The driving system as claimed in claim 10, wherein:

said control block is disposed to receive source logic data composed of a number M of brightness bits, the source logic data to indicate one of $2^M$ levels of brightness, where M is an integer and M≥2, the brightness bits having different bit orders and being classified into a first bit group and a second bit group, the bit order of each of the brightness bit(s) of the first bit group being higher than that of each of the brightness bit(s) of the second bit group; and said control block is further configured to divide the source logic data into M sets of logic data each corresponding to a respective one of the brightness bits, and to output the M sets of logic data after division in an output sequence such that each set of logic data whose corresponding brightness bit is classified into the first bit group serves as the first logic data, and each set of logic data whose corresponding brightness bit is classified into the second bit group serves as the second logic data.

14. The driving system as claimed in claim 13, wherein M≥3, and in the output sequence, at least one set of logic data whose corresponding brightness bit is classified into the second bit group is arranged between two sets of logic data whose corresponding brightness bits are both classified into the first bit group.

15. The driving system as claimed in claim 14, wherein the bit orders of the brightness bits are defined to be integers ranging from 0 to M−1, said driving system satisfying:

$$2^{k_1}T_2 \geq 2T_1 \text{ and } 2^{k_2}T_2 < 2T_1$$

wherein 1 represents a length of time required by said shift register unit to receive and store either one of the first logic data and the second logic data, $T_2$ represents a length of time the driving output is provided to the light emitting device when the driving output is converted from the second logic data that corresponds to the set of logic data whose corresponding brightness bit has the bit order of 0, $k_1$ represents the bit order of an arbitrary one of the brightness bits classified into the first bit group, and $k_2$ represents the bit order of an arbitrary one of the brightness bit(s) classified into the second bit group; and wherein an overall length of time the driving output is provided to the light emitting device is $2^kT_2$ when the driving output is converted from the set of logic data whose corresponding brightness bit has the bit order of k.

16. The driving system as claimed in claim 15, further satisfying $R=2^{k_{1f}-j+1}-1$, where R represents a number of said at least one set of logic data whose corresponding brightness bit is classified into the second bit group, $k_{1f}$ represents the bit order corresponding to a leading one of said two sets of logic data whose corresponding brightness bits are both classified into the first bit group, and j represents the lowest bit order among the bit orders of the brightness bits classified into the first bit group.

17. The driving system as claimed in claim 16, wherein M≥4, and in the output sequence, said leading one of said two sets of logic data is arranged before said at least one set of logic data whose corresponding brightness bit is classified into the second bit group and after another one set of logic data whose corresponding brightness bit is classified into the second bit group and has the bit order of t, said driving system further satisfying: $2^tT_2=T_1$.

18. The driving system as claimed in claim 10, wherein:

said control block outputs the clock signal to said shift register unit;

said control block outputs a latch enable signal to said data latch unit, and said data latch unit latches and stores therein the first logic data according to the latch enable signal;

said control block outputs a select signal to said multiplexer unit, and said multiplexer unit outputs to said driving unit one of the first logic data and the second logic data according to the select signal; and said control block outputs an output enable signal to said driving unit, and said driving unit provides the driving output to the light emitting device according to the output enable signal.

19. The driving system as claimed in claim 18, wherein said control block includes:

a control unit configured to generate the clock signal, the output enable signal, and a latch signal, and to output the first logic data and the second logic data each having at least one logic value, the clock signal being outputted during output of either one of the first logic data and the second logic data, and having a number of clock cycles associated with a number of the logic values of said either one of the first logic data and the second logic data; and a switching unit coupled to said control unit for receiving the latch signal and one of the clock signal and the output enable signal, configured to output the latch enable signal, and configured to output the select signal according to the latch signal in response to a trigger by said one of the clock signal and the output enable signal.

20. The driving system as claimed in claim 19, wherein said data latch unit further receives the latch signal, and stores the first logic data according to the latch enable signal and the latch signal.

21. The driving system as claimed in claim 20, wherein:

said switching unit receives the clock signal and the latch signal, and is configured to output the latch enable signal that has a logic level adjusted to be opposite to that of the latch signal in response to a positive edge of the clock signal; and said switching unit is responsive to a negative edge of the latch signal to:

output the select signal that enables the multiplexer unit to output the first logic data when the latch enable signal has one of a high logic level and a low logic level; and invert a logic level of the select signal when the latch enable signal has the other one of the high logic level and the low logic level.

22. The driving system as claimed in claim 20, wherein:

said switching unit receives the latch signal and the output enable signal, and is configured to output the latch enable signal that is the same as the output enable signal; and said switching unit is responsive to a negative edge of the output enable signal to:

output the select signal that enables the multiplexer unit to output the first logic data when the latch signal has one of a high logic level and a low logic level; and output the select signal that enables the multiplexer unit to output the second logic data when the latch signal has the other one of the high logic level and the low logic level.

23. The driving system as claimed in claim 19, wherein:

said switching unit receives the clock signal and the latch signal, and is further configured to generate an intermediate signal that has a logic level adjusted to be opposite to that of the latch signal in response to a positive edge of the clock signal, and to output, in response to a negative edge of the latch signal, a pulse to serve as the latch enable signal when the intermediate signal has one of a high logic level and a low logic level; and said switching unit is responsive to a negative edge of the latch signal to:

output the select signal that enables the multiplexer unit to output the first logic data when the intermediate signal has said one of the high logic level and the low logic level; and invert a logic level of the select signal when the intermediate signal has the other one of the high logic level and the low logic level.

24. The driving system as claimed in claim 19, wherein:

said switching unit receives the latch signal and the output enable signal, and is further configured to output, in response to a negative edge of the latch signal, a pulse to serve as the latch enable signal when the output enable signal has one of a high logic level and a low logic level; and said switching unit is responsive to a negative edge of the output enable signal to:

output the select signal that enables the multiplexer unit to output the first logic data when the latch signal has the other one of the high logic level and the low logic level; and output the select signal that enables the multiplexer unit to output the second logic data when the latch signal has said one of the high logic level and the low logic level.

* * * * *